US005806966A

United States Patent [19]

Crowder et al.

[11] Patent Number: 5,806,966

[45] Date of Patent: Sep. 15, 1998

[54] ILLUMINATED GRATE

[75] Inventors: Judith M. Crowder; DeAnn McKinley, both of Forth Worth, Tex.

[73] Assignee: McKinley Tree Grate Co., Inc., Fort Worth, Tex.

[21] Appl. No.: 597,546

[22] Filed: Feb. 2, 1996

[51] Int. Cl.[6] ..... F21V 33/00

[52] U.S. Cl. ..... 362/253; 362/291; 362/805

[58] Field of Search ..... 362/123, 227, 362/290, 291, 84, 263, 805, 806, 253

[56] References Cited

U.S. PATENT DOCUMENTS

| | | | |
|---|---|---|---|
| D. 229,080 | 11/1973 | Mihm . | |
| D. 268,084 | 3/1983 | Haggard . | |
| D. 270,609 | 9/1983 | Haggard . | |
| D. 274,210 | 6/1984 | Haggard . | |
| D. 274,211 | 6/1984 | Haggard . | |
| D. 283,003 | 3/1986 | McKinley . | |
| D. 285,406 | 9/1986 | Haggard . | |
| D. 291,049 | 7/1987 | Haggard . | |
| 640,140 | 12/1899 | Lloyd . | |
| 1,719,518 | 7/1929 | Nissen et al. | 362/227 |
| 1,921,614 | 8/1933 | Frei . | |
| 2,226,915 | 12/1940 | Trowbridge | 362/806 |
| 2,279,182 | 4/1942 | Snyder . | |
| 3,802,708 | 4/1974 | Libert | 362/806 |
| 4,592,165 | 6/1986 | Sisk . | |
| 4,594,646 | 6/1986 | Von Kohorn et al. . | |
| 4,686,611 | 8/1987 | Von Kohorn . | |
| 4,858,085 | 8/1989 | Von Kohorn . | |
| 5,003,724 | 4/1991 | Vestuti . | |

*Primary Examiner*—Y My Quach
*Attorney, Agent, or Firm*—Laubscher & Laubscher

[57] ABSTRACT

A grate body contains a plurality of open slot areas receiving translucent inserts, and a lighting unit is arranged below the grate for illuminating the inserts. The lighting unit includes a sealed hollow housing having a transparent upper surface, and at least one lighting device mounted in the housing. The housing electrically insulates the components contained therein while allowing sufficient heat transfer to cool the neon tube. A circular grate embodiment is also disclosed having a lighting unit contained therein for illuminating the circumference of the grate.

8 Claims, 5 Drawing Sheets

ILLUMINATED GRATE

CROSS-REFERENCE TO RELATED APPLICATION

This application is related to the co-pending U.S. application Ser. No. 08/570,679 filed by the same inventors on Dec. 11, 1995.

FIELD OF THE INVENTION

The present invention relates to an illuminated tree grate having lighting means arranged in slots or other open areas contained therein, thereby creating a lighting effect which provides safety, security, and if desired, a form of advertising, and which enhances the appearance of the grate and surrounding landscape.

BRIEF DESCRIPTION OF THE PRIOR ART

Land developers, such as landscape architects, are constantly seeking new ways to enhance the designs of courtyards, parks, malls, city streets, and other public and private grounds. Because such areas are often accessible to a large number of people, the designs and the products they employ must be designed with safety as a primary concern. In addition, for outside designs, the products must be designed to withstand prolonged exposure to rain, snow, and other deleterious elements.

Presently, most grates, whether used around trees, fountains, or as a decorative walking surface, rely on the shape, texture, and configuration of the grate to enhance its appearance. Consequently, the variety of designs is somewhat limited.

The U.S. patent to Von Kohorn U.S. Pat. No. 4,686,611 discloses an illuminating apparatus in which light is projected upwardly through a compartmentalized grille to achieve a glare-free lighting effect of a three-dimensional object such as a plant or sculpture. The purpose of the lighting is to illuminate an object positioned over the grille and, therefore, does not provide any decorative or ornamental lighting to enhance the aesthetic appearance of the grille itself. Rather, the light is simply projected through the grille.

The U.S. patent to Lloyd U.S. Pat. No. 640,140 discloses an illuminated sidewalk sign having an incandescent light which projects light upwardly through a sign level with the sidewalk which includes a layer of glass. The light is supported by a box placed in an opening in the sidewalk or by a support arm connected with the underside of the sidewalk. This device requires a large open space below the sign to house the lighting fixture which must be positioned directly below the sign to effectively illuminate the sign.

The present invention was developed to overcome these and other drawbacks of the prior devices by providing a decoratively illuminated grate which is designed to enhance the appearance of the grate itself and thereby refine the surrounding landscape. The grate includes translucent inserts arranged around the perimeter of the grate and/or within open areas of the grate and a light source positioned to direct light through the translucent inserts.

SUMMARY OF THE INVENTION

Accordingly, it is a primary object of the present invention to provide a decoratively lighted grate in which the open slot areas of the grate and/or perimeter of the grate include translucent inserts the upper surfaces of which are flush with or preferably slightly below the top surface of the grate, which grate further includes a light source for directing light through the translucent insert.

It is a further object of the present invention to provide a lighted grate including a housing mounted below the top surface of the grate for receiving both the translucent insert and the light source, which housing provides a water-tight environment for the light source.

It is another object of the present invention to provide a lighted grate using neon lights contained within the housing to illuminate the selected open areas of the grate.

It is a yet further object of the present invention to provide a circular horizontally-arranged grate having an illuminated outer perimeter.

It is yet another object of the invention to provide a lighted grate in which the light source is resiliently mounted within the housing, the light source being electrically insulated from the housing while permitting heat generated by the light to dissipate.

BRIEF DESCRIPTION OF THE DRAWINGS

Other objects and advantages of the invention will become apparent from a study of the following specification when viewed in light of the accompanying drawings, in which.

DETAILED DESCRIPTION

Figure 1:
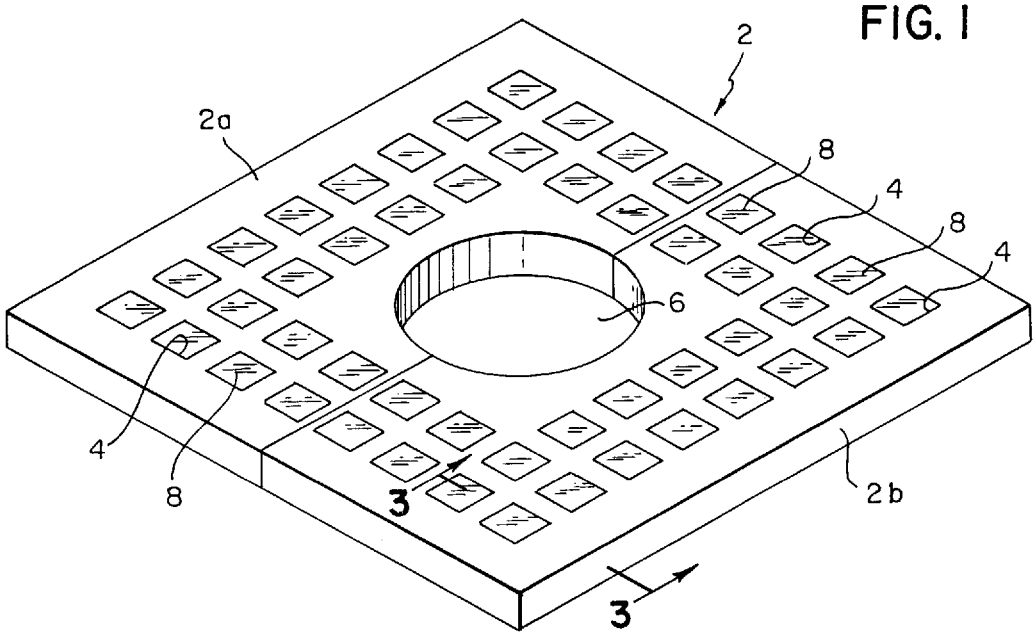
FIG. 1 is a perspective view of a square grate with square openings or slots according to the invention.

Referring first to FIG. 1, a rigid grate 2 formed of metal, such as cast iron, aluminum, or bronze, a suitable synthetic plastic material such as LEXAN, or reinforced concrete, contains a plurality of square openings 4 and a larger central opening 6 adapted to receive the trunk of a tree, a fountain of water, or the like. Each opening 4 contains a translucent insert 8 formed of, for example, glass or a suitable synthetic plastic material. Although illustrated as being square, the openings 4 can be configured in various geometric shapes such as circles, triangles, or stars, and can be arranged in various patterns. Similarly, the grate 2 can be configured in various geometric shapes. In addition, the top surface of the grate can be textured, can include a decorative pattern, and can be contoured or warped slightly to promote drainage toward the outer edge of the grate. To facilitate transportation, installation, and maintenance, the grate 2 is sectional and includes two halves 2*a* and 2*b* which are arranged to form the grate.

Figure 2:
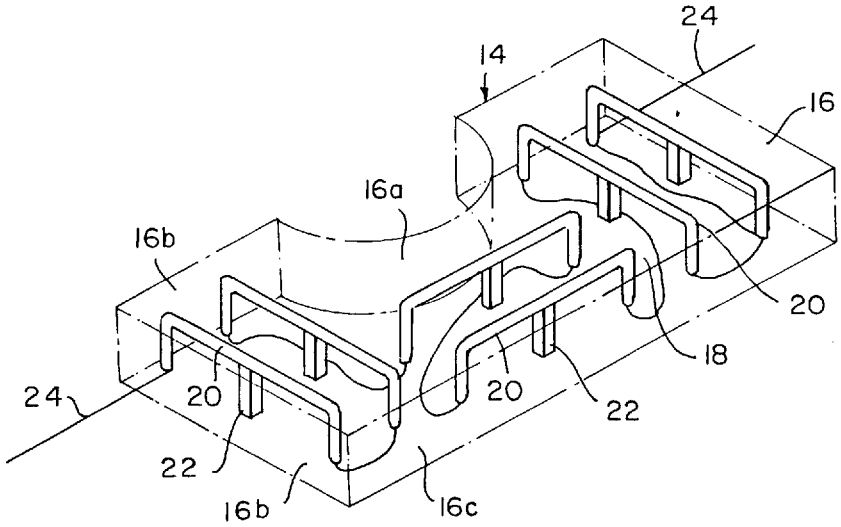
FIG. 2 is a perspective schematic view of the housing containing a plurality of neon lighting tubes.

FIG. 2 shows a lighting unit 14 adapted to fit under one of the grate halves 10, 12. Two lighting units, one for each grate half are thus needed to illuminate the whole grate. The lighting unit includes a hollow housing 16 having a transparent top portion 16*a* (FIG. 3) which allows light to be transmitted upon the translucent inserts 8 and which is shatter-resistant for safety reasons. The sides 16*b* and bottom 16*c* of the housing may be formed of a durable clear synthetic plastic material, such as LEXAN. The housing contains a chamber 18 in which are mounted a plurality of neon tubes 20, each of which is supported within the chamber by at least one resilient mount 22.

The mounts 22 serve to support the neon tubes 20, to absorb shocks resulting from sudden impacts, and to space the tubes from the walls of the housing, thereby allowing air to circulate and cool the tubes. The mounts are electrically insulating and mechanically shock resistant and may be formed of a suitable elastomeric material, such as silicone. Housed and mounted in this manner, the neon tubes are protected from water damage and are also protected against damage which might occur from shock loading. Alternatively, microbulb or electroluminescent lighting could be used, as well as other light sources such as incandescent, fluorescent, light-emitting-diodes (LED), tungsten, halogen, fiberoptics, cold cathode or quartz lighting devices.

Figure 3:
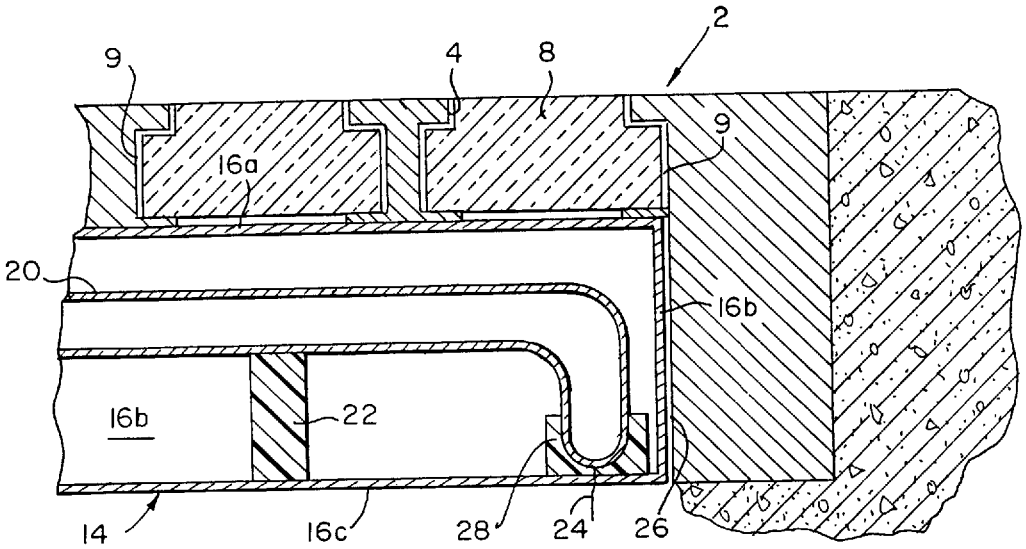
FIG. 3 is a sectional view taken along line 3—3 of FIG. 1.

Power supply conductors 24 connected with a power source, (not shown) provide power to the neon tubes 20 which are, in turn, wired together in series. These conductors extend through potted strain-relieved sealed openings contained in housing bottom wall 16*c*, as shown in FIG. 3. The lighting unit 14 is positioned below the grate 2 within a recess 26. During installation, the grate is simply placed over the lighting unit with the neon tubes 20 aligned beneath the translucent inserts 8, whereby light is directed upwardly thereupon.

It is important to note that the inserts 8 are self-cleaning, owing to the small clearance spaces 9 provided between the inserts and the adjacent walls of the grate openings 4, thereby permitting water and dirt to be drained from the translucent insert and the grate. The recessed design is much that the manner of mounting of the insert in the grate is concealed from view. This not only enhances the visual appearance of the grate but also provides a safe and secure product that is less vulnerable to vandalism. The frame of the grate may be cast into concrete, as shown in FIG. 3.

Figure 4:
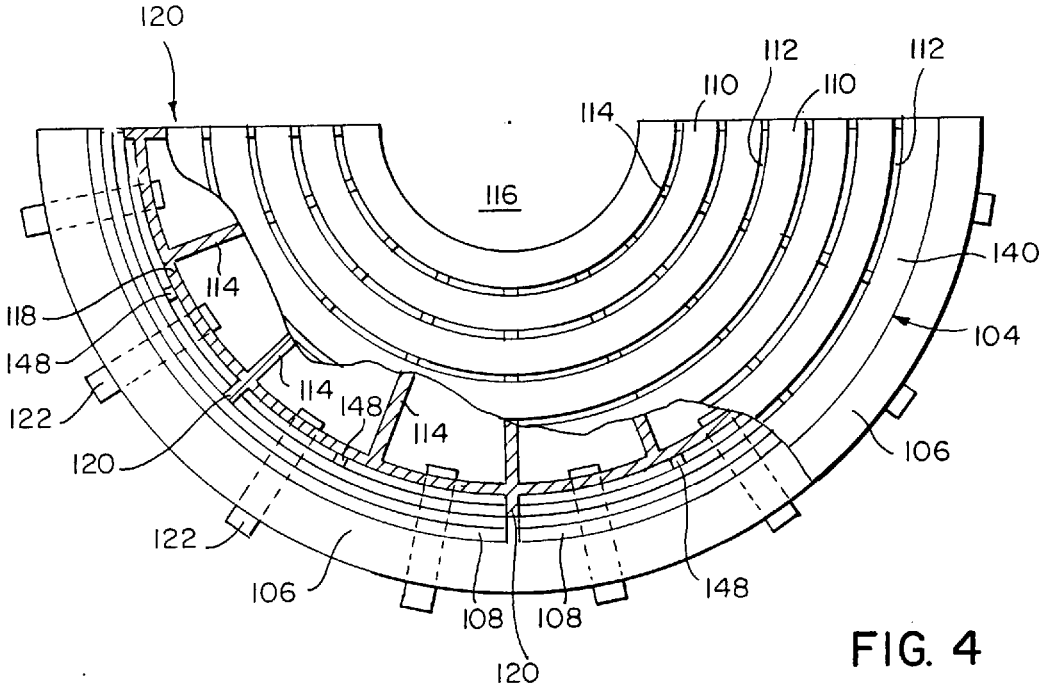
FIG. 4 is a partially sectioned top view of a second embodiment of the invention.
Figure 5:
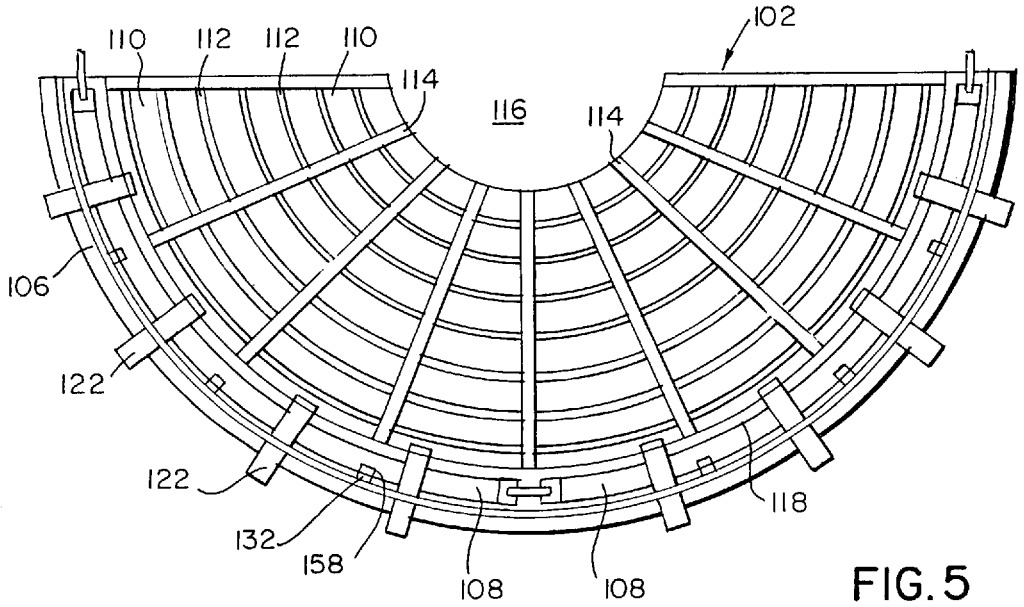
FIG. 5 is a bottom view of the second embodiment of the invention.

Referring now to FIGS. 4 and 5, there is shown one half of an illuminated circular grate assembly 102 including a grate 104, an annular frame 106, and plurality of lighting units 108.

The grate 104 includes a plurality of spaced annular rings 110 which define therebetween a plurality of concentrically arranged annular slots 112. A plurality of radially extending ribs 114 extend from a central opening 116 to a concentric outer rib 118 and serve to interconnect the rings. A plurality of projections 120 extend radially outwardly from concentric rib 118 opposite every other rib 114 and serve to align the grate 104 during assembly.

The lighting units 108 are arranged along the inner perimeter of the frame 106 beneath and around the outer perimeter of the grate 104. Although four such lighting units would be used to illuminate the entire circumference of the grate shown, with each unit extending along one quarter of the grate perimeter, other configurations using different numbers of lighting units are possible.

A plurality of radially extending bars 122 extend from beyond the outer perimeter of the frame 106 inwardly beneath the frame and lighting units 108 to the concentric rib 118.

Figure 6:
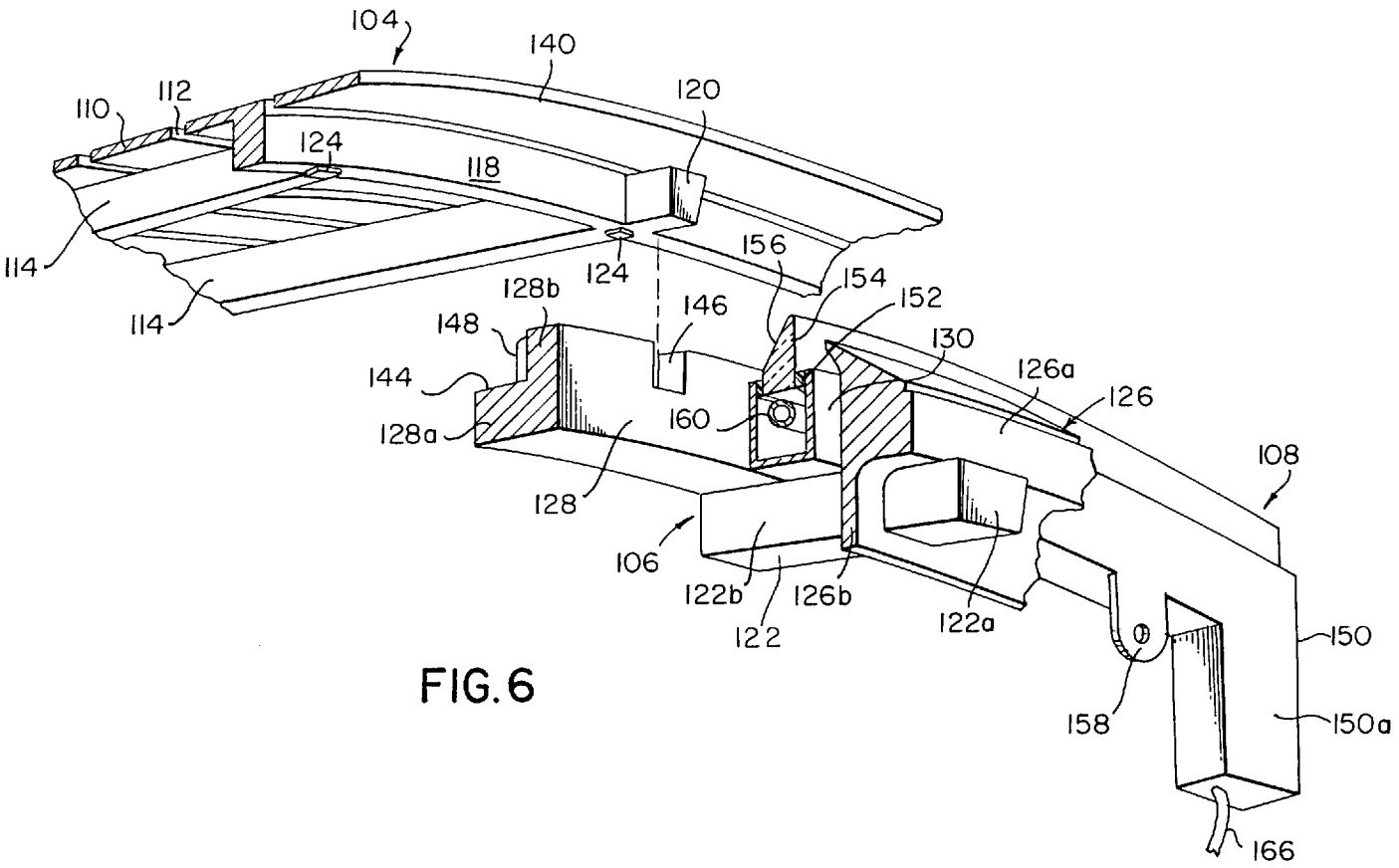
FIG. 6 is a partially exploded perspective view of the second embodiment.
Figure 7:
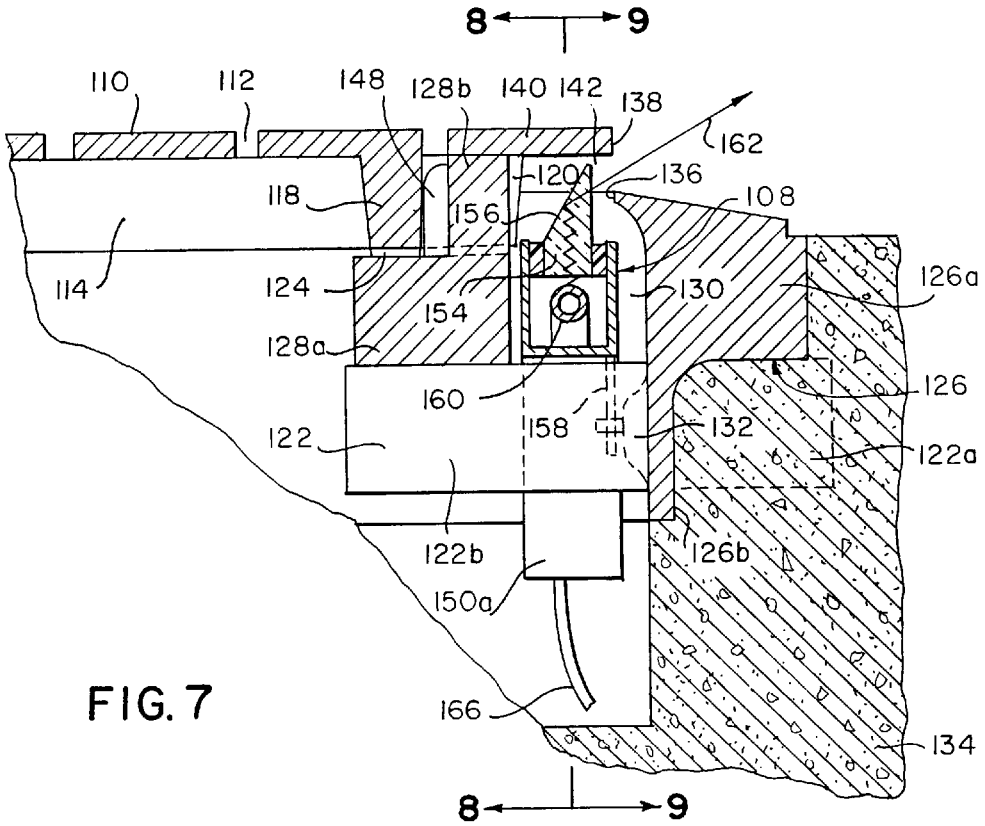
FIG. 7 is a sectional view taken along line 7—7 of FIGS. 8 and 9.

Referring now to FIGS. 6 and 7, the bottom surface of concentric rib 118 is provided with a plurality of mounting pads 124 which space the grate 104 from the frame 106 and provide mounting stability for the grate.

Frame 106 includes an annular outer frame ring 126, and a radially inwardly spaced annular inner frame ring 128, thereby defining an annular chamber 130 therebetween, the outer frame ring 126 and inner frame ring 128 being connected via radial bars 122.

Outer frame ring 126 includes an upper portion 126*a* and a tapered downwardly extending skirt portion 126*b*. A plurality of protruding bosses 132 (FIG. 7), on which the lighting units 108 are mounted, extend radially inwardly from the skirt portion 126*b*. Bars 122 include an outwardly extending portion 122*a* and an inwardly extending portion 122*b* which extends inwardly below the lighting unit 108.

As shown in FIG. 7, the outer frame ring 126 and the outwardly extending portion 122*a* of bar 122 are formed into a concrete wall 134 which defines a tree well, or the like.

The inner edge 136 of upper portion 126*a* of the outer frame ring is arranged in spaced relation below the outer edge 138 of the outermost ring 140, thereby defining a vertical opening 142.

The inner frame ring 128 is supported on the radially inwardly directed portion 122*b* of bar 122 and is radially spaced from and generally parallel to outer frame ring 126, thereby defining chamber 130 therebetween which receives the lighting unit 108. Inner frame ring 128 has a generally L-shaped cross-sectional configuration and includes a base portion 128*a* defining a contact surface 144 and an upwardly extending portion 128*b* containing a plurality of grooves 146 spaced to receive projections 120. Inner frame ring 128 also includes a plurality of stand-offs 148 which extend inwardly from upper portion 128*b* and which serve to space concentric rib 118 from upper portion 128*b*, thereby preventing projections 120 from striking light unit 108 as the grate is lowered into position during assembly. In this manner, when grate 104 and frame 106 are assembled, mounting pads 124 engage contact surface 144 and projections 120 are received in grooves 146, thereby ensuring proper alignment of the grate.

The lighting unit 108 includes an elongated generally U-shaped housing 150 which is open at the top, thereby defining a slot 152. Arranged within the slot is an arcuate-shaped translucent prism 154 extending upwardly from the slot toward the bottom surface of the outermost ring 140. The prism is mounted in the slot using an elastomeric material, such as silicone, which forms a watertight seal. The prism includes an angled upper surface 156 which slopes upwardly outwardly in the direction of the outer frame ring 126. A plurality of brackets 158 extend downwardly from the bottom of the housing 150 on the side adjacent the outer frame ring 126. Each bracket 158 receives a corresponding boss 132 and thereby serves to mount the lighting unit housing on the outer frame ring 126.

A generally U-shaped neon lighting tube 160 contained within housing 150 emits light energy 162 which is directed upwardly through prism 154, reflected off of angled upper surface 156, and directed outwardly through vertical opening 142. Alternatively, a microbulb strip or fiber optic light source could be used. While not all of the light energy is reflected off of angled surface 156, the angled surface increases the amount of light energy directed through vertical opening 142.

Figure 9:
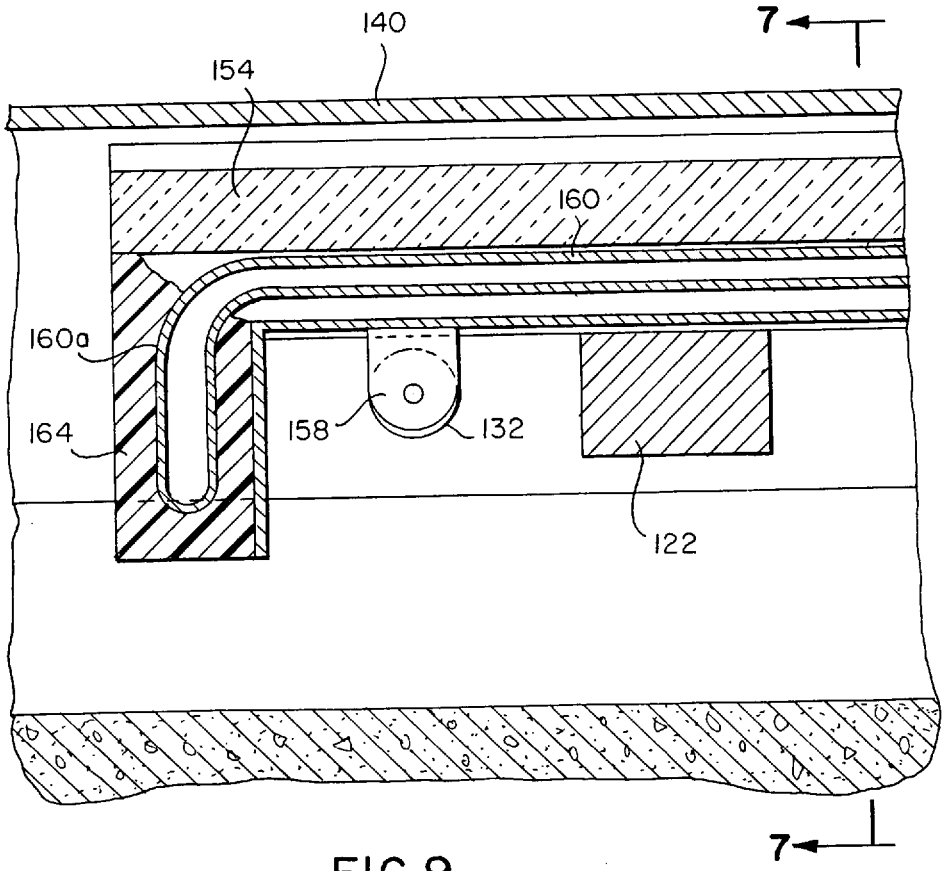
FIG. 9 is a sectional view taken along line 9—9 of FIG. 7.
Figure 8:
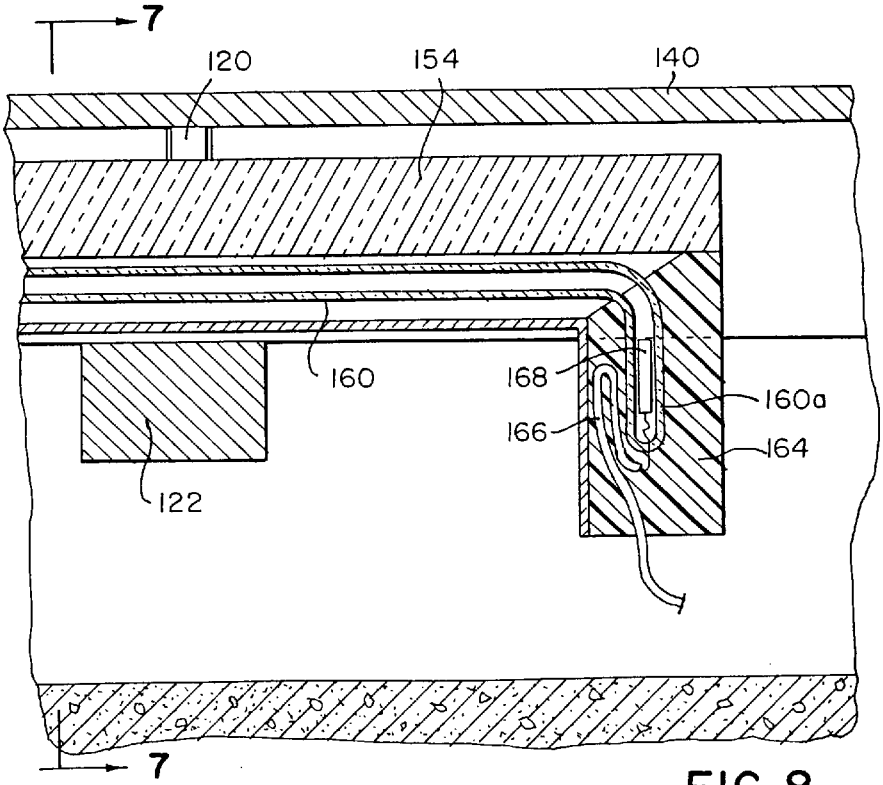
FIG. 8 is a sectional view taken along line 8—8 of FIG. 7.

As shown in FIGS. 8 and 9, the housing 150 includes a downwardly extending end portion 150*a*, within which the downwardly extending end 160*a*, of the neon tube are potted in an elastomeric compound 164, such as silicon. The elastomeric compound forms a water resistant housing and provides support for the neon tube so that the neon tube is positioned centrally in housing 150 to allow air to circulate and cool the neon tube.

The ends of the neon tubes include looped wires 166 which connect an electrode 168 contained within the neon tube with a power source and/or an adjacent lighting unit. The tubes are supported within the associated housings by resilient stand-offs 169. The wire loop is embedded in the elastomeric compound 164, thereby providing strain relief between the wire and housing. It will be recognized that any number of lighting units, each having an arcuate shape conforming to the circumference of annular chamber 130 may be used to provide illumination of the entire perimeter of the grate.

As indicated above, the rigid grate may be formed of cast metal, synthetic plastic material, or reinforced concrete. The grate may be used in connection with trees, poles, landscape illumination and other indoor and outdoor installations.

While in accordance with the provisions of the Patent Statutes the preferred forms and embodiments of the invention have been illustrated and described, it will be apparent to those of ordinary skill in the art that various changes and modifications may be made without deviating from the inventive concept set forth above.

What is claimed is:

1. A lighted grate, comprising:

(a) horizontal annular frame means (106) including a pair of concentrically arranged annular outer (126) and inner (128) frame members that define therebetween an annular space (130);

(b) horizontal annular grate means (104) removably mounted concentrically within said frame means, said grate means including:

(1) a plurality of annular concentrically spaced rings (110); and (2) a plurality of radially extending ribs (114) interconnecting said rings;

(3) an outermost one (140) of said rings extending above said annular space at a higher elevation than mid outer frame member, thereby to define an outer peripheral opening (142); and (c) illuminating means (108) arranged in said annular space for illuminating and transmitting light energy radially outwardly from said peripheral opening.

2. A lighted grate as defined in claim 1, wherein said outer annular frame member includes on its inner circumference a plurality of circumferentially spaced radially inwardly directed support bars (122), said inner frame member being supported on said support bars.

3. A lighted grate as defined in claim 2, wherein said illuminating means includes:

(1) a hollow lighting housing (150) supported by said outer frame member, said housing defining a chamber and having a translucent horizontal member (154) mounted in an opening contained in an upper portion of said housing; and (2) a light source (160) mounted in said chamber and arranged to direct light upon said translucent member.

4. A lighted grate as defined in claim 3, wherein said light source includes a neon lighting tube.

5. A lighted grate as defined in claim 3, wherein said translucent member includes an inclined upper surface relative to said grate means, thereby to direct light energy outwardly via said peripheral opening.

6. A lighted grate as defined in claim 3, wherein said housing is generally U-shaped and includes a pair of leg portions straddling at least one of said support bars.

7. A lighted grate as defined in claim 6, and further including means connecting said lighting housing with said outer frame member.

8. A lighted grate as defined in claim 1, wherein said grate means and said annular frame means are sectional and are diametrically divided to define a pair of semicircular half-sections, respectively.

* * * * *